United States Patent [19]

Sato et al.

[11] Patent Number: 4,653,945

[45] Date of Patent: Mar. 31, 1987

[54] ROTARY WHEEL PRINTING APPARATUS WITH CONTROLLABLE HAMMER STRIKING FORCE

[75] Inventors: Masafumi Sato, Fuji; Tsuyoshi Matsushita, Shizuoka, both of Japan

[73] Assignee: Tokyo Electric Co., Ltd., Tokyo, Japan

[21] Appl. No.: 667,764

[22] Filed: Nov. 2, 1984

[30] Foreign Application Priority Data

Nov. 14, 1983 [JP] Japan ..... 58-213533

[51] Int. Cl.[4] ..... B41J 1/30

[52] U.S. Cl. ..... 400/144.2; 400/166; 101/93.03; 364/519

[58] Field of Search ..... 400/144.2, 157.3, 166; 101/93.03, 93.18, 93.19; 364/518, 519

[56] References Cited

U.S. PATENT DOCUMENTS 3,858,509 1/1975 Grundherr .
4,118,129 10/1978 Grundherr .
4,189,246 2/1980 Kane et al. ..... 400/144.2
4,293,233 10/1981 Hoffman .
4,399,749 8/1983 Arai ..... 400/120
4,541,061 9/1985 Schoon ..... 364/519

FOREIGN PATENT DOCUMENTS

3143138A1 5/1982 Fed. Rep. of Germany .
3232142A1 5/1983 Fed. Rep. of Germany .

*Primary Examiner*—Edgar S. Burr
*Assistant Examiner*—David A. Wiecking
*Attorney, Agent, or Firm*—Frishauf, Holtz, Goodman & Woodward

[57] ABSTRACT

There is provided a printing apparatus which drives a printing wheel in response to a rotation angle data corresponding to an input character code and drives a printing hammer with an impact force corresponding to this input character code. A data processing circuit reads out the rotation angle data from a first memory, supplies a drive data corresponding to this rotation angle data to wheel driving circuit through a first data bus, and reads out the impact force data from a second memory and supplies it to a hammer driving circuit through a second data bus. The information relating to a character is accessed from the first and second memories via the same address.

7 Claims, 4 Drawing Figures

ROTARY WHEEL PRINTING APPARATUS WITH CONTROLLABLE HAMMER STRIKING FORCE

BACKGROUND OF INVENTION

The present invention relates to a printing apparatus for printing types with different impact forces in correspondence with characters that should be printed.

Conventionally, there is known a daisy wheel type printing apparatus which is equipped with a daisy wheel having a plurality of supporting plates which extend radially and each of which has a type at its end portion.

Among such printing apparatuses, there is a printing apparatus in which an impact force of a printing hammer is changed in accordance with a character to be printed in order to make the densities of the characters printed on a paper uniform. For example, in the case of printing a period "." having a small type area, the impact force of the printing hammer is set to be weak, while in the case of printing a character such as "W" or the like having a large type area, the impact force of this printing hammer is set to be large.

In such a printing apparatus, a rotation angle data and impact force data corresponding to each character are stored in a memory; the printing wheel is rotated into a desired location on the basis of the rotation angle data in accordance with an input character code; and the type is printed by the printing hammer on the basis of the impact force designated by the corresponding impact force data. In this manner, a desired character can be printed on paper.

For instance, in a certain printing apparatus, there are used a first memory for storing the rotation angle data of the printing wheel corresponding to each character code and a second memory for storing the impact force data of the printing hammer corresponding to each character code. When a character code is inputted, a central processing unit (CPU) reads out, individually and respectively, the rotation angle data and impact force data corresponding to this input character code from the first and second memories. The CPU then supplies them to a printing wheel driver and a printing hammer driver. This makes it possible to print each character with a desired impact force. However, the CPU is required to individually control the first and second memories, so that a complicated control program is needed. Further in this case, it is impossible to simultaneously read out the data from the first and second memories, resulting in the reduction of the data processing speed.

In another printing apparatus, a memory is used for storing the printing data indicative of the rotational angular position of the printing wheel and the impact force of the printing hammer that correspond to each character code. The CPU reads out the printing data corresponding to the input character code from this memory and simultaneously supplies the rotation angle data and impact force data included in this printing data to the printing wheel driver and printing hammer driver, respectively. Thus, the rotation angle data and impact force data corresponding to each character code are simultaneously read out. However, this causes the number of bits of printing data including both data to be enlarged. Since the capacity of the data bus is restricted and it is undesirable to reduce the number of bits of the rotation angle data, it is required in turn to decrease the number of bits of the impact force data. In a particular case, the impact can be merely set to strong and weak forces; therefore, the densities of the characters printed cannot be made sufficiently uniform.

SUMMARY OF THE INVENTION

It is an object of the present invention to provide a printing apparatus in which the designated characters, in accordance with the input character code and without making a control program complicated, can be printed at a uniform printing density by simultaneously reading out the rotation angle data of the printing wheel and impact force data of the printing hammer.

This object is accomplished by providing a printing apparatus comprising a wheel driving circuit for driving a printing wheel which has types arranged at its peripheral portion in accordance with a given rotation angle data; a hammer driving circuit for driving a printing hammer with an impact force corresponding to a given impact force data; first and second memories in which rotation angle data and impact force data corresponding to a character code are stored; and a data processing circuit which simultaneously supplies an address signal corresponding to the character code indicative of a character to be printed to the first and second memories, which reads out the rotation angle data corresponding to this character code from the first memory and supplies the data to the wheel driving circuit, and which reads out the impact force data corresponding to the character code from the second memory, wherein the impact force data which was read out from the second memory is directly supplied to the hammer driving circuit.

In this invention, by supplying the same address data, the rotation angle data and impact force data can be respectively read out from the first and second memories simultaneously. In addition, since the impact force data is transferred from the second memory to the hammer driving circuit through a bypass data bus, there is no need to increase the bit capacity of the main data bus.

DETAILED DESCRIPTION OF THE PREFERRED EMBODIMENT

Figure 1:
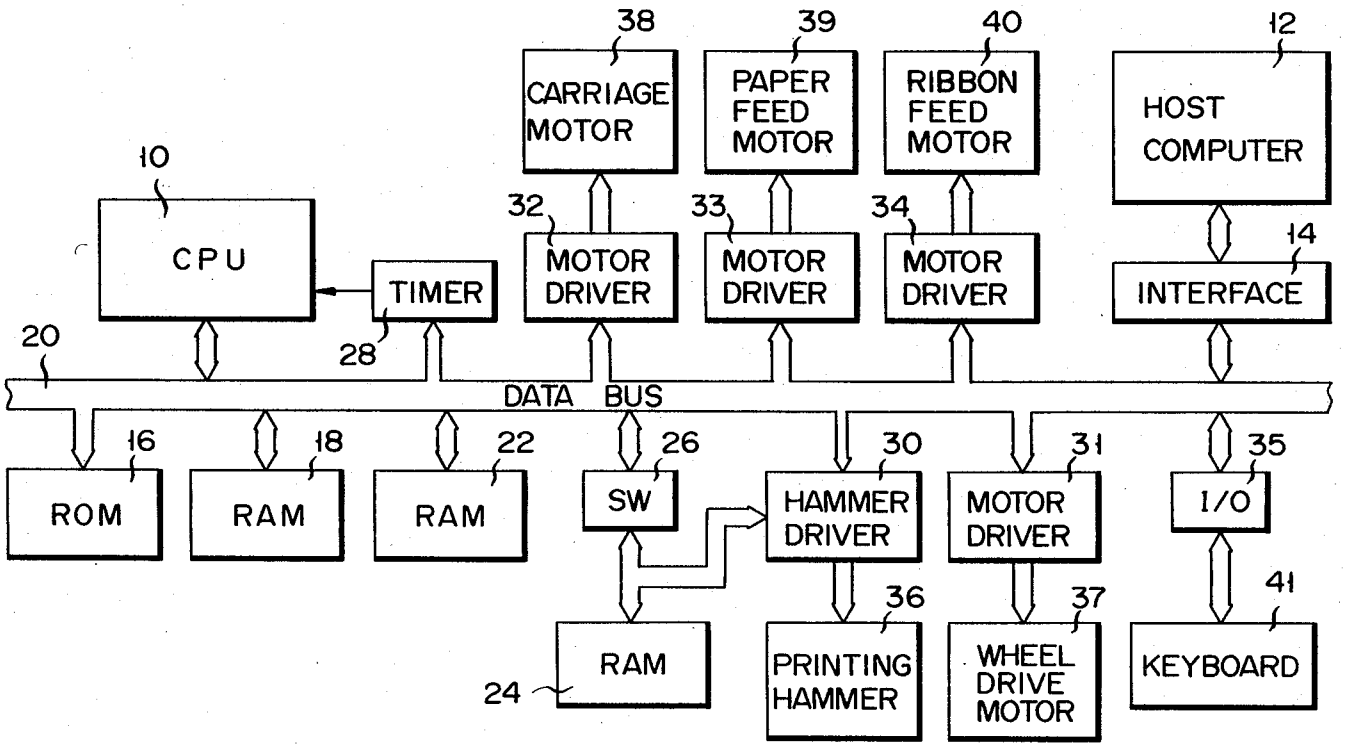
FIG. 1 is a schematic block diagram showing a printing apparatus according to one embodiment of the present invention.

FIG. 1 shows a schematic block diagram of a printing apparatus according to one embodiment of the present invention. This printing apparatus includes: a CPU 10; a host computer 12 for supplying character codes corresponding to characters to be printed to the CPU 10 through an interface 14; a read only memory (ROM) 16 in which a control program used in data processing by the CPU 10 is stored; a random access memory (RAM) 18 for storing data such as character codes and the like which are supplied from the host computer 12 through an eight-bit data bus 20; and RAMs 22 and 24 in which rotation angle data of a daisy printing wheel and impact force data of a printing hammer that correspond to each character code are stored respectively. The RAM 24 is coupled to the data bus 20 through a switching circuit 26. Further, the CPU 10 is coupled to a timer 28, drivers 30 to 34 and an I/0 port 35 through the data bus 20. A printing hammer 36, a printing wheel motor 37, a carriage motor 38, a paper feed motor 39, and a ribbon feed motor 40 are coupled to these drivers 30 to 34. A keyboard circuit 41 is coupled to the I/0 port 35.

Figure 2:
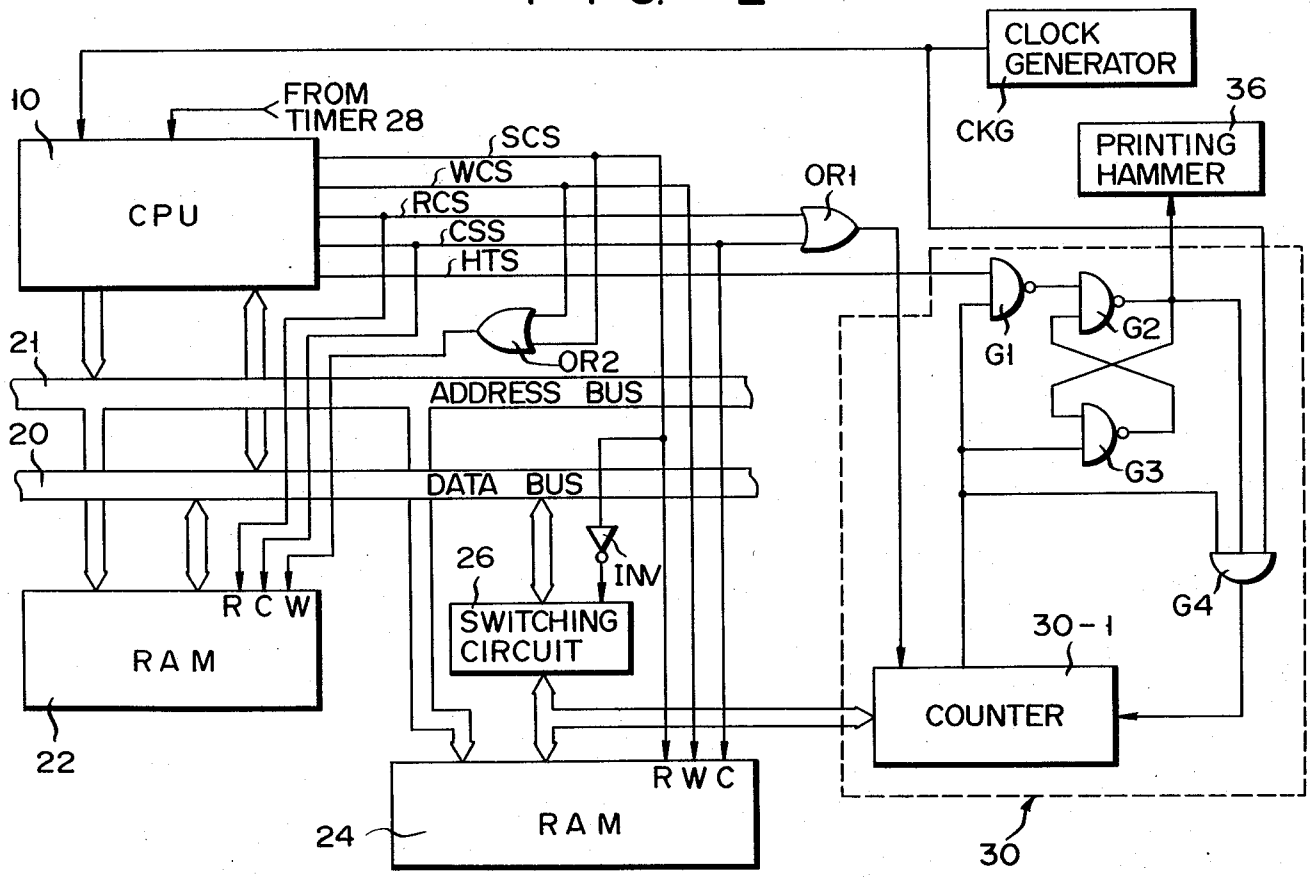
FIG. 2 is a block diagram of a principal section of the printing apparatus shown in FIG. 1.

FIG. 2 shows in further detail the connecting relations among the CPU 10, RAMs 22 and 24, switching circuit 26, driver 30, and printing hammer 36. As shown in FIG. 2, the CPU 10 supplies address data to the RAMs 22 and 24 through an address bus 21 and generates a readout control signal RCS, a write-in control signal WCS, a switch control signal SCS, a chip select signal CSS, and a hammer trigger signal HTS. The readout control signal RCS is supplied to a READ terminal of the RAM 22, and at the same time, it is supplied through an OR gate OR1 to a LOAD terminal of a counter 30-1 in the hammer driver 30. The write-in control signal WCS is supplied to a WRITE terminal of the RAM 24 and is also supplied through an OR gate OR2 to a WRITE terminal of the RAM 22. The chip selection signal CSS is supplied to CHIP SELECT terminals of the RAMs 22 and 24 and is also supplied through the OR gate OR1 to the LOAD terminal of the counter 30-1. The switch control signal SCS is supplied through the OR gate OR2 to the WRITE terminal of the RAM 22 and is supplied through an inverter INV to a control terminal of the switching circuit 26. Also, the signal SCS is supplied to a READ terminal of the RAM 24. Further, the hammer trigger signal HTS is supplied to a NAND gate G1 in the hammer driver 30. An output terminal of the NAND gate G1 is coupled to one input terminal of a NAND gate G2 which together with a NAND gate G3 constitutes a flip flop. An output terminal of the NAND gate G2 is coupled to the printing hammer 36 and is also coupled to one input terminal of an AND gate G4. An output terminal of the counter 30-1 is coupled to each second input terminal of the gates G1, G2 and G3. Further, an output terminal of a clock generator CKG for supplying a clock pulse to the CPU 10 is coupled to a count-down terminal of the counter 30-1 through the AND gate G4.

Figure 3:
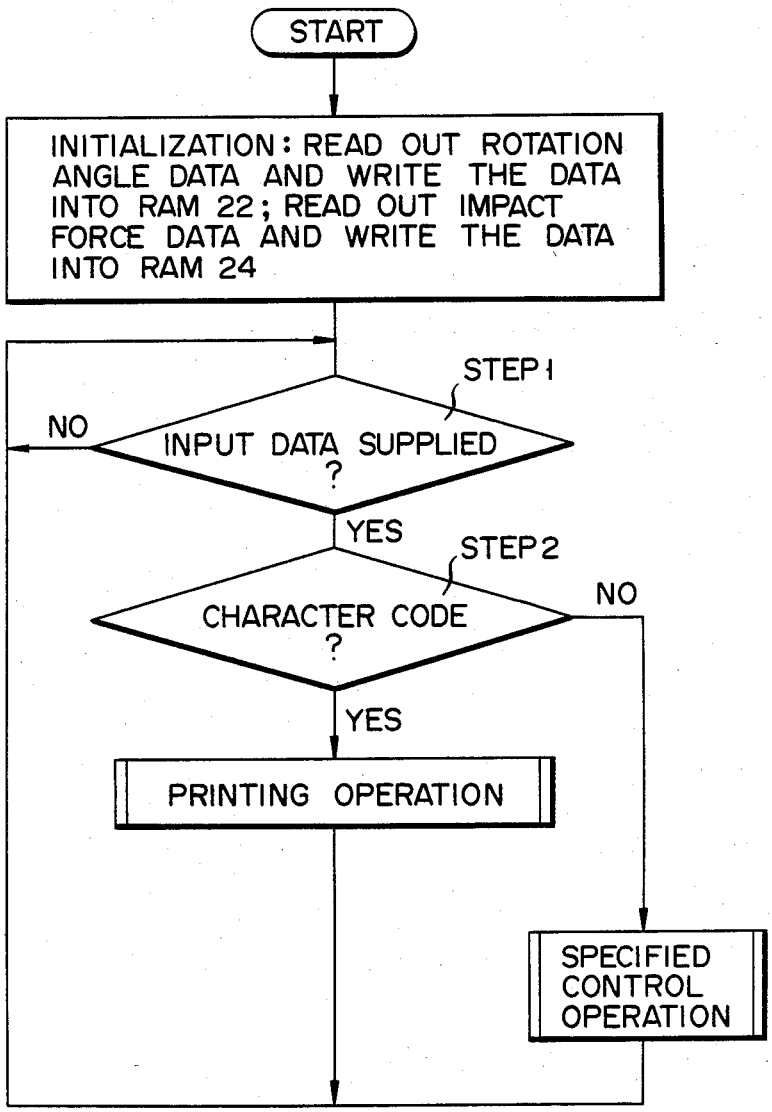
FIGS. 3 and 4 show flow charts for explaining the operation of the printing apparatus shown in FIGS. 1 and 2.

The operation of the printing apparatus shown in FIGS. 1 and 2 will be explained in accordance with flow charts shown in FIGS. 3 and 4.

In addition to the control program, the data indicative of the rotational angular position of the printing wheel and the impact force of the printing hammer that correspond to each character code are stored in the ROM 16. These rotation angle data and impact force data are supplied to the RAMs 22 and 24, respectively, in the initialization step. For instance, when the CPU 10 detects the turn-on of the power supply, it generates the switch control signal SCS at a low level, thereby setting the switching circuit 26 into the OFF state. Further, the CPU 10 sets the write-in control signal WCS and chip select signal CSS at a low level. Thus, the RAMs 22 and 24 are set into the data write-in mode. Under such a state, the CPU 10 reads out the rotation angle data corresponding to each character code from the ROM 16 and sequentially supplies them onto the data bus 20. The rotation angle data on the data bus 20 are sequentially stored into the memory locations designated by the address data corresponding to the respective character codes in RAM 22. However, since the switching circuit 26 is in the OFF state, they are not supplied to the RAM 24. After the rotation angle data corresponding to all of the character codes have been completely read out from the ROM 16, the CPU 10 then sets the switch control signal SCS at a high level. Thus, the switching circuit 26 is set into the ON state. On the other hand, since this high-level switch control signal SCS is also supplied to the WRITE terminal of the RAM 22 through the OR gate OR2, the RAM 22 is set into the write-inhibit state.

Next, the CPU 10 reads out the impact force data corresponding to each character data from the ROM 16 and sequentially supplies them onto the data bus 20. The impact force data on the data bus 20 are sequentially stored through the switching circuit 26 into the memory locations of RAM 24 designated by the address data corresponding to the respective character codes in the RAM 22. In this case, since the RAM 22 is in the write-inhibit state, the impact force data is not stored in the RAM 22. The rotation angle data and impact force data which were read out from the ROM 16 in this way are respectively stored in the memory locations designated by the same address data in the RAMs 22 and 24. In this state, the CPU 10 waits until data is supplied from the host computer 12 or keyboard circuit 41 in STEP 1.

When it is assumed that data is supplied from the host computer 12 through the interface 14, the CPU 10 detects that the data was inputted in STEP 1. Then, the CPU 10 checks this input data to see if it is the printing data or not in STEP 2. In STEP 2, in the case where the CPU 10 detects that the input data is not the printing data but the control data indicative of the tab-set position setting, margin position setting, carriage return, etc., the CPU 10 executes the control function designated by this input control data. Thereafter, the CPU 10 returns the processing routine to STEP 1. On the contrary, when the CPU 10 detects that the input data is the character code in STEP 2, it allows the character corresponding to this input character code to be printed on a paper (not shown).

Figure 4:
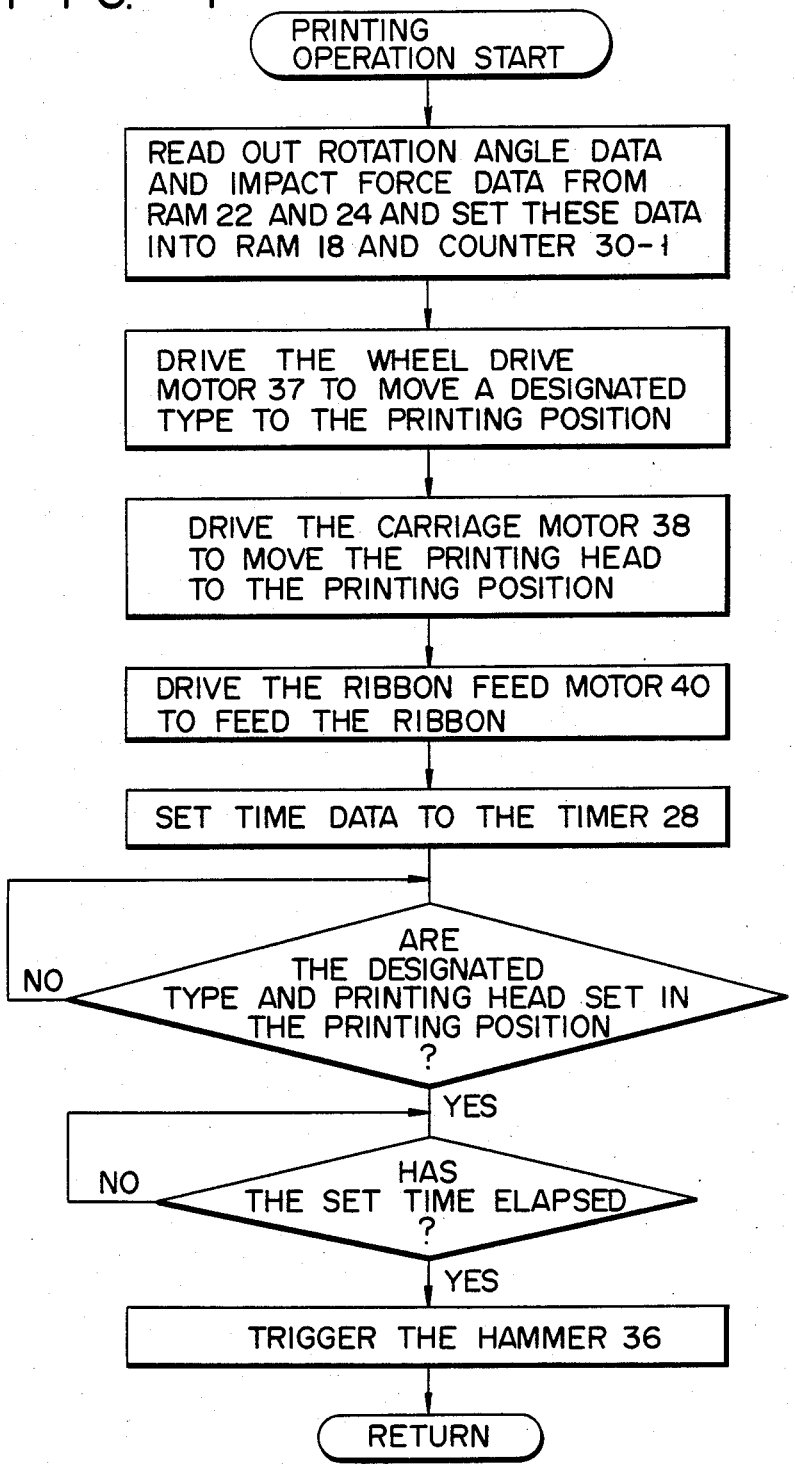

In this printing operation, as shown in FIG. 4, the CPU 10 first reads out the rotation angle data and impact force data from the memory locations corresponding to the input character code in the RAMs 22 and 24, respectively. Then, the CPU 10 sets them into the RAM 18 and counter 30-1. Namely, the CPU 10 sets the switch control signal SCS, readout control signal RCS and chip selection signal CSS at a low level. Thus, the RAMs 22 and 24 are set into the readout mode and the switching circuit 26 is set into the OFF state. In this state, the CPU 10 supplies the address data corresponding to the input character code to the RAMs 22 and 24 through the address bus 21. Due to this, the rotation angle data and impact force data corresponding to the input character code are read out from the RAMs 22 and 24. The CPU 10 stores the rotation angle data read out from the RAM 22 onto the data bus 20 into the specified memory area in the RAM 18. On the other hand, the impact force data read out from the RAM 24 is not transferred onto the data bus 20 since the switching circuit 26 is in the OFF state, but it is supplied to the counter 30-1 through a bypass data bus. In this case, since both readout control signal RCS and chip selection signal CSS are at a low level, a low-level signal is supplied to the LOAD terminal of the counter 30-1. Therefore, the impact force data from the RAM 24 is set into the counter 30-1. Thereafter, the CPU 10 allows the printing wheel (not shown) to be rotated by the corresponding angle in the corresponding direction on the basis of the rotation angle data stored in the specified memory area in the RAM 18 and the rotation angle data stored in a different memory area, i.e., data representing the present position of the printing wheel, thereby permitting the type designated by the input character code to be moved to the printing position. At the same time, the CPU 10 drives the carriage motor 38 to move the carriage to which the printing wheel is attached to the printing position. At this time, the CPU 10 drives the ribbon feed motor 40 to feed the ribbon by a predetermined amount, then the CPU 10 drives the paper feed motor 39 to feed the paper by a predetermined amount as necessary. Next, the CPU 10 also sets the time data to the timer 28. This time data corresponds to the time necessary for sufficient attenuation of the vibration which is caused in the type when the type was moved and set to the printing position. When the time counting operation of the timer 28 is completed and when it is detected that the type and printing head designated by the input character code are set to the printing position, the CPU 10 generates the hammer trigger signal to drive the printing hammer 36. That is, the high-level output signal is generated from the counter 30-1 in this state, and a signal at "1" level is supplied to the NAND gates G1 and G3. When the high-level or "1" level hammer trigger signal HTS is supplied from the CPU 10 in this state, a "1" level signal is generated from the NAND gate G2. This permits a current to start flowing through a solenoid (not shown) in the printing hammer 36. At this time, since the AND gate is enabled in response to the "1" level signals from the counter 30-1 and NAND gate G2, the clock pulse generated from the clock generator CKG is supplied to the counter 30-1, thereby counting down the content of the counter 30-1 by one count. This count-down operation is continued until the content of the counter 30-1 becomes "0," and the level of the output signal from the counter 30-1 becomes low. Namely, a current flows through the solenoid of the printing hammer 36 for the time interval corresponding to the impact force data which was read out from the RAM 24 and set to the counter 30-1; thus, the printing hammer 36 prints the type set to the printing position with the impact force corresponding to the impact force data. As described above, a type is printed on a paper with the impact force which has been properly preset, so that each character can be printed with a relatively uniform density.

Although the present invention has been described above with respect to one embodiment, the invention is not limited to only this embodiment. For example, the rotation angle data is stored in the RAM 22, but this RAM 22 may be omitted and the rotation angle data may be stored in a partial memory area in the RAM 18.

What is claimed is:

1. A printing apparatus comprising:

wheel drive means operating in accordance with a given rotation angle data;

hammer drive means for driving a printing hammer with an impact force corresponding to a given impact force data;

first and second memory means for storing, respectively, rotation angle data and impact force data corresponding to a character code and coupled, respectively, to said wheel drive means and hammer drive means through first and second data buses, said first and second memory means being individually addressible; and data processing means for giving an address signal corresponding to the character code indicative of a character to be printed to said first and second memory means, for reading out the rotation angle data from said first memory means to supply a drive data corresponding to this read out rotation angle data to said wheel drive means through said first data bus, and for simultaneously reading out the impact force data from said second memory means and supplying this impact force data to said hammer drive means through said second data bus.

2. A printing apparatus according to claim 1, wherein said data processing means has a data processing circuit and third memory means which is coupled to said data processing circuti through a third data bus and in which the rotation angle data and impact force data corresponding to each character code are stored, and said apparatus further comprises switching means coupled between said third data bus and said second memory means, said data processing circuit keeping said switching means in the OFF state while the rotation angle data is being read out from said third memory means.

3. A printing apparatus according to claim 2, wherein said hammer drive means has an energization signal generating means which receives the impact force data from said second memory means and supplies an energization signal to said printing hammer for an interval corresponding to said impact force data.

4. A printing apparatus according to claim 3, wherein said energization signal generating means comprises: clock generating means; counting means which receives the impact force data from said second memory means and generates an output signal when it has finished counting clock pulses from said clock generating means of the number corresponding to said impact force data; and logic circuits for inhibiting the clock pulses from said clock generating means being supplied to said counting means in response to an output signal from the counting means.

5. A printing apparatus according to claim 1, wherein said hammer drive means has an energization signal generating means which receives the impact force data from said second memory means and supplies an energization signal to said printing hammer for an interval corresponding to said impact force data.

6. A printing apparatus according to claim 5, wherein said energization signal generating means comprises: clock generating means; counting means which receives the impact force data from said second memory means and generates an output signal when it finished counting clock pulses from said clock generating means of the number corresponding to said impact force data; and logic circuits for inhibiting the clock pulses from said clock generating means being supplied to said counting means in response to an output signal from the counting means.

7. A printing apparatus comprising:

wheel drive means operating in accordance with a given rotation angle data;

hammer drive means for driving a printing hammer with an impact force corresponding to a given impact force data;

first and second memory means for storing, respectively, rotation angle data and impact force data corresponding to a character code and coupled, respectively, to said wheel drive means and hammer drive means through first and second data buses, said first and second memory means being individually addressable;

third memory means connected to said first data bus for storing the rotation angle data and impact force data corresponding to each character code;

switching means connected between said first data bus and said second memory means; and data processing means including, means for generating an address signal corresponding to the character code indicative of a character to be printed and for providing said address signal to said first and second memory means, means for intilizing the first and second memories by retrieving the rotation angle data and impact force data from said third memory means, and writing the rotation angle data into said first memory means through said first data bus and the impact force data into said seconod memory means through said first data bus, a switching means and a second data bus, and means for retrieving the rotation angle data from said first memory means to supply a drive data corresponding to such retrieved rotation angle data to said wheel drive means through said first data bus, and at the same time retrieving the impact force data from said second memory means and supplying such retrieved impact force data to said hammer drive means through said second data bus while keeping said switching means in an OFF state to inhibit passage of signals therethrough.

* * * * *